United States Patent [19]

Demoulin et al.

[11] Patent Number: 4,668,018

[45] Date of Patent: May 26, 1987

[54] ROTARY CUTTER WITH SPRAY NOZZLES FOR REMOVAL OF ORES FROM MINE FACES

[75] Inventors: Jean Demoulin, Ippling, France; Walter Hemmer, Neunkirchen; Reinhard Schiel, Landstuhl/Süd, both of Fed. Rep. of Germany

[73] Assignee: Charbonnages de France, Paris, France

[21] Appl. No.: 722,738

[22] Filed: Apr. 12, 1985

[30] Foreign Application Priority Data

Apr. 14, 1984 [DE] Fed. Rep. of Germany ..... 3414198

[51] Int. Cl.[4] ..... E21C 35/22; E21F 5/02

[52] U.S. Cl. ..... 299/81; 299/17

[58] Field of Search ..... 299/81, 79, 89, 16, 299/17; 175/67, 393, 422; 222/526, 533, 537; 285/166, 266; 403/122

[56] References Cited

U.S. PATENT DOCUMENTS

| | | | |
|---|---|---|---|
| 2,819,875 | 1/1958 | Gage | 175/422 |
| 3,747,982 | 7/1973 | Agnew et al. | 299/81 |
| 3,876,253 | 4/1975 | Parker | 299/81 |
| 3,997,111 | 12/1976 | Thomas et al. | 299/17 X |
| 4,219,239 | 8/1980 | Weikert et al. | 299/81 |
| 4,280,735 | 7/1981 | Lobbe | 299/17 X |
| 4,465,320 | 8/1984 | Schupphaus | 299/81 |
| 4,498,707 | 2/1985 | Best et al. | 299/81 |
| 4,533,005 | 8/1985 | Morris | 175/422 X |

FOREIGN PATENT DOCUMENTS

| | | | |
|---|---|---|---|
| 3222580 | 2/1984 | Fed. Rep. of Germany | 299/17 |
| 3326859 | 7/1984 | Fed. Rep. of Germany | 299/79 |
| 2041043 | 9/1980 | United Kingdom | 299/17 |
| 2070104 | 9/1981 | United Kingdom | 299/85 |
| 718599 | 2/1980 | U.S.S.R. | 299/17 |

*Primary Examiner*—Stephen J. Novosad
*Assistant Examiner*—Michael A. Goodwin
*Attorney, Agent, or Firm*—Peter K. Kontler

[57] ABSTRACT

The rotor of a cutter for removal of ore from mine faces has several external material removing bits which are mounted in holders at the exterior of the rotor, and the holders have sockets for discrete spray nozzles which discharge streams of highly pressurized water against the mine face and/or against the bits. The nozzles receive water from discrete conduits whose discharge ends are threadedly connected with the respective nozzles and whose intake ends are connected to the outlets of manifolds which are installed in the interior of the rotor. The conduits extend from the outlets of the respective manifolds and through holes which are provided therefor in the rotor. The sockets in the holders receive spherical joints which allow for changes in orientation of the nozzles with reference to the adjacent bits.

26 Claims, 4 Drawing Figures

ROTARY CUTTER WITH SPRAY NOZZLES FOR REMOVAL OF ORES FROM MINE FACES

BACKGROUND OF THE INVENTION

The present invention relates to material removing tools in general, and more particularly to improvements in rotary cutters of the type disclosed, for example, in U.S. Pat. No. 4,244,626 granted Jan. 13, 1981 to Klaus Konieczny et al. Cutters of the type to which the present invention pertains can be used with advantage in so-called advance working machines or moles wherein a boom carries one or more rotary cutters serving to penetrate into the material of a mine face and to remove therefrom rock, ore and/or other solid materials. Still more particularly, the invention relates to rotary cutters of the type wherein a rotor is driven by a shaft and carries a plurality of external material removing bits as well as a plurality of external nozzles serving to direct sprays of a fluid medium (normally water) against the mine face and/or against the bits.

The purpose of nozzles is to reduce the generation of dust, to cool the bits, and to extinguish sparks which develop as a result of penetration of bits into the material along the mine face. Presently known rotors of such cutters are provided with internal compartments which deliver the fluid medium to the orifices of the nozzles.

It was further proposed to use sprays of highly pressurized water as a means for removing comminuted material from the region where the bits penetrate into the mine face. To this end, the pressure of water must be raised to several hundred bars. However, it was found that such elevated pressures in the regions of the nozzles can be achieved only at an extremely high cost as well as that the presently achievable pressures do not invariably suffice to ensure satisfactory removal of comminuted or fragmentized material from the regions of the bits.

OBJECTS AND SUMMARY OF THE INVENTION

An object of the invention is to provide a novel and inproved rotary cutter wherein the nozzles can receive a fluid medium at a pressure which is several times the pressure of fluid media which are supplied to the nozzles of conventional cutters.

Another object of the invention is to provide novel and improved nozzles for use in the above outlined cutter.

A further object of the invention is to provide a novel and improved rotor for use in the rotary cutter.

An additional object of the invention is to provide a novel and improved liquid supplying system for use in the above outlined rotary cutter.

Another object of the invention is to provide a relatively simple, compact and inexpensive rotary cutter which can supply to its nozzles a fluid medium at a pressure that cannot be achieved in conventional cutters.

A further object of the invention is to provide a rotary cutter which can be installed in existing mining and like machines as a superior substitute for heretofore known cutters.

An additional object of the invention is to provide a novel and improved support for the nozzles in a rotary cutter of the above outlined character.

The invention is embodied in a rotary cutter which can be used with advantage as a means for gouging out ore, rock or the like from mine faces in surface mines or in underground excavations. The improved cutter comprises a preferably cup-shaped hollow rotor, a plurality of material removing bits at the exterior of the rotor, a plurality of spray nozzles at the exterior of the rotor (the cutter preferably comprises at least one discrete nozzle for each bit), and novel and improved means for supplying a highly pressurized fluid medium (particularly water) to the nozzles. The supplying means includes at least one manifold which is installed in the interior of and rotates with the rotor and has a plurality of outlets, a pipe or the like for admitting fluid medium into the manifold, and conduits which directly connect the outlets of the manifold with discrete nozzles. The conduits extend through holes which are machined into or otherwise provided in the rotor. The rotor is preferably provided with sockets for the nozzles, and the discharge ends of the conduits extend into the respective sockets and are directly secured to the respective nozzles. The sockets can be provided in holders which are located at the exterior of the rotor and carry the bits.

Each nozzle preferably comprises a tubular mouthpiece which communicates with the discharge end of the respective conduit and each nozzle preferably further comprises a screw cap having internal threads in mesh with external threads provided on the discharge end of the respective conduit to bias the mouthpiece against the discharge end. Each screw cap has one or more orifices which permit one or more fluid streams to issue from the discharge ends of the respective conduits by way of the corresponding mouthpieces. Each mouthpiece has an axial passage which preferably tapers in a direction toward the orifice or orifices of the respective screw cap. The mouthpieces can contain or consist of a hard metal which is preferably coated with a suitable wear-resistant ceramic material. The discharge ends of the conduits are preferably provided with counterbores for portions of the respective mouthpieces. Furthermore, the discharge ends can be formed with internal shoulders at the bottoms of the respective counterbores and the mouthpieces can be provided with sharp annular edges which bear against the shoulders of the respective discharge ends under the action of the associated caps. If the mouthpieces are not recessed into the discharge ends of the respective conduits, the sharp annular edges at their rear ends can be caused to bear against the front end faces of the respective discharge ends.

Annular inserts of a hard strongly wear-resistant mineral substance can be inserted between the mouthpieces and the respective caps, and each such insert provides a path or passage for the flow of pressurized fluid medium from the passage of the respective mouthpiece into the orifice or orifices of the respective cap. Collars can be provided to surround the inserts and the front faces of the mouthpieces (which preferably consist of steel or another hard metal) are preferably provided with projections which penetrate into the respective collars under the action of the corresponding caps. Such collars can serve as reliable seals to prevent leakage of pressurized fluid medium on its way from the passage of a mouthpiece into the orifice or orifices of the respective cap.

The rotor preferably further comprises joints, most preferably spherical joints, which are installed therein and each of which receives the discharge end of a conduit so as to allow for changes in orientation of the nozzles and the discharge ends of the respective conduits relative to the rotor. The discharge ends of the conduits can be arranged to perform swiveling or analogous movements with reference to the rotor so as to ensure that the sprays of fluid medium are caused to flow in predetermined directions in order to reliably cool the adjacent bits, to extinguish sparks which are generated by the bits during penetration into the mine face and/or to remove substantial quantities of comminuted or fragmentized material from the mine face. Each joint can comprise a spherical member which surrounds the discharge end of the respective conduit and a ring which is installed in the rotor and has a concave seat for the spherical member. Each spherical member and/or each ring can be assembled of several separable sections. Each ring is preferably formed with a conical (particularly frustoconical) external surface and the cutter further comprises means for securing the rings of the joints to the rotor. Such securing means can comprise externally threaded annular members which mate with the rotor and have conical seats or recesses for the respective rings. Furthermore, the rotor is preferably provided with shoulders which are adjacent to the larger-diameter ends of the external surfaces of the respective rings and against which the rings are biased by the respective externally threaded annular members. Such annular members can include annular portions which spacedly surround and shield the respective nozzles.

The holes of the rotor are dimensioned to allow for changes in orientation of the discharge ends of the conduits and of the respective nozzles relative to the rotor. For example, each such hole can have an enlarged portion which is preferably bounded by a frustoconical surface and diverges in a direction from the respective joint toward the interior of the rotor. As mentioned above, the rotor can include or carry holders for the bits and the just mentioned enlarged portions of the holes can be provided in such holders.

The novel features which are considered as characteristic of the invention are set forth in particular in the appended claims. The improved cutter itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
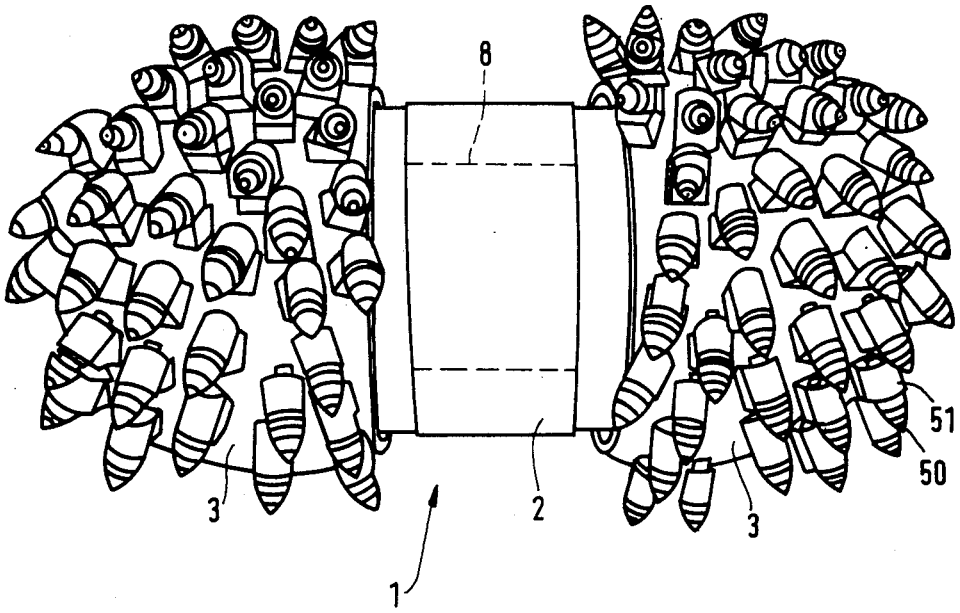
FIG. 1 is a front elevational view of a rotary cutter with two rotors wherein the nozzles at the exterior of the rotors receive a pressurized fluid medium from supplying means embodying the present invention.

The rotary cutter 1 which is shown in FIG. 1 comprises two coaxial rotors 3 mounted at the opposite ends of a hollow support 2 containing a shaft 8 which receives torque from a suitable prime mover by way of an additional shaft surrounded by a boom which carries the cutter. The boom is located behind the support 2, as viewed in FIG. 1. The cutter 1 is movable up and down as well as sideways so that the numerous material removing bits 50 at the exterior of its rotors 3 can remove material from a mine face. Each of the bits 50 is mounted on a discrete holder 51 which is welded or otherwise rigidly secured to the exterior of the respective rotor 3. This can be readily seen in FIG. 2 which shows a portion of one of the rotors 3 in a fragmentary axial sectional view and further shows the details of means for supplying a highly pressurized fluid medium (normally water) to the orifices of nozzles 45 which are installed in sockets 47 provided therefor in the holders 51.

Figure 2:
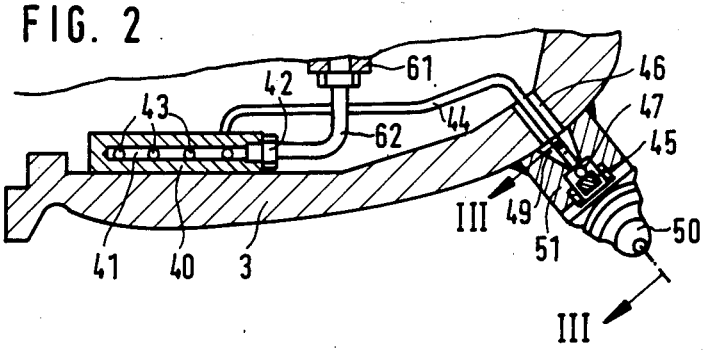
FIG. 2 is an enlarged fragmentary axial sectional view of one of the rotors showing certain parts of the respective fluid medium supplying means, one of the nozzles and one of the bits.
Figure 4:
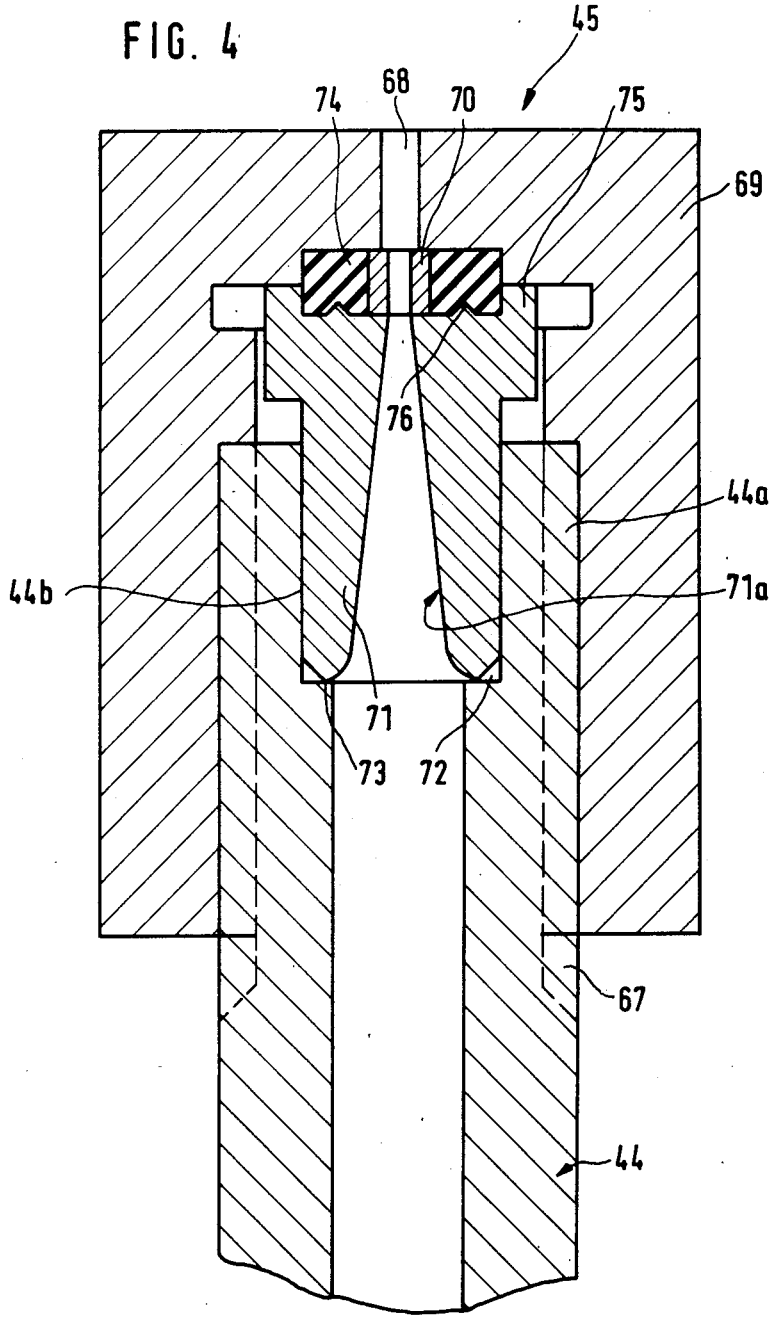
FIG. 4 is a greatly enlarged axial sectional view of a nozzle and of the discharge end of the respective conduit.

The internal chamber of the rotor 3 which is shown in FIG. 2 receives a plurality of (e.g., eight) uniformly distributed elongated strip- or box-shaped manifolds 40 (only one shown) each of which can be provided with an axial channel 41 communicating with several (e.g., eight) outlets 43 for pressurized fluid medium. FIG. 2 merely shows one row of four spaced-apart outlets 43; the other four outlets 43 are provided in the broken-away front portion of the illustrated manifold 40. The number of outlets 43 in a manifold 40, multiplied by the total number of manifolds, equals the number of nozzles 45 at the exterior of the respective rotor 3. The inlet of the manifold 40 of FIG. 2 receives a stream of pressurized fluid medium from a pipe 62 by way of a coupling 42 which sealingly secures the discharge end of the pipe 62 to the manifold. The intake end of the pipe 62 receives a stream of pressurized fluid medium from one of several channels in an internal sleeve of the rotor 3 in a manner as shown in FIGS. 4 and 5 of the commonly owned copending patent application Ser. No. 722,737 filed Apr. 12, 1985 by Jean Demoulin et al. for "Rotary cutter for gouging out ore from mine faces". FIG. 2 merely shows a coupling 61 which sealingly secures the pipe 62 to the discharge end of the respective channel in the aforementioned sleeve of the rotor 3.

Figure 3:
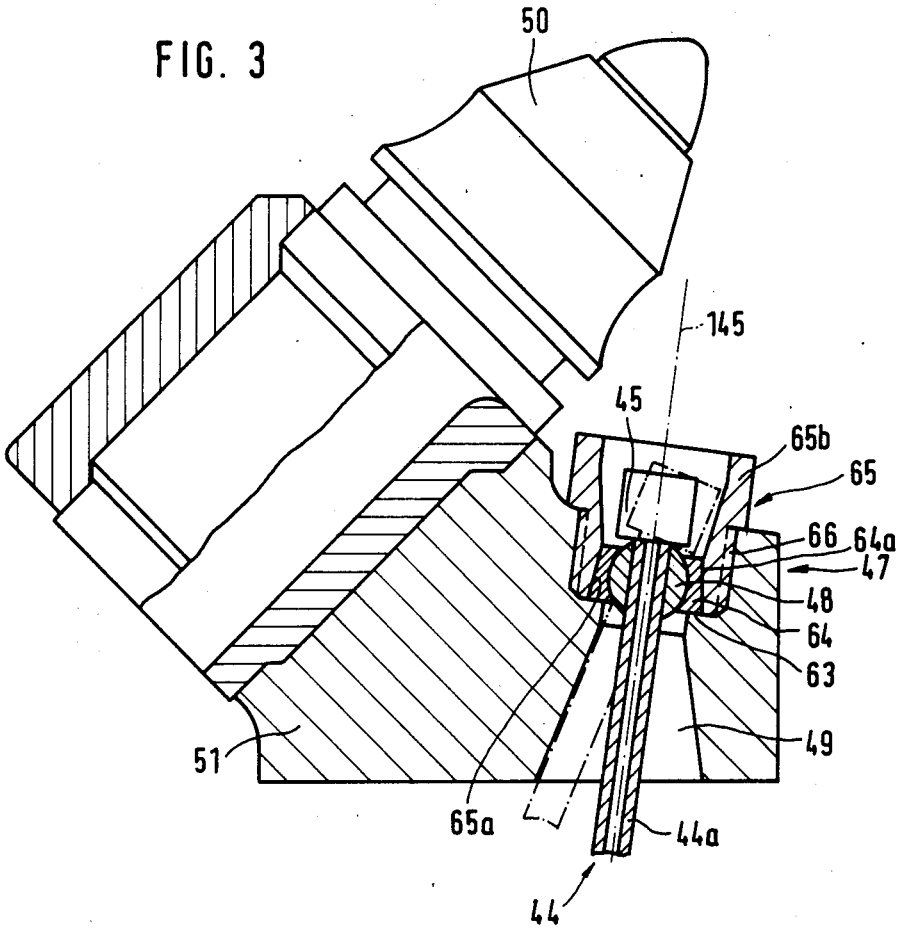
FIG. 3 is a greatly enlarged view of a detail in FIG. 2, showing the bit, the nozzle, a spherical joint for the nozzle, the means for securing the joint to the holder for the bit, and the discharge end of the respective conduit.

The manifolds 40 are preferably mounted close to the open end of the cup- or bell-shaped rotor 3 and each of their outlets 43 is connected with a discrete nozzle 45 by a conduit 44 a portion of which extends through a hole 46 in the rotor 3. As can be seen in FIG. 3, the discharge end **44*a* of each conduit 44 is surrounded by a preferably composite (multiple-section) or slotted spherical member 48 which is installed in a preferably composite (multiple-section) or slotted ring 64 which, in turn, is installed in the socket 47 of the respective holder 51. The member 48 and the ring 64 together constitute a spherical joint which allows the discharge end 44*a* of the respective conduit 44 to change its orientation with reference to the rotor 3 and to thus change the orientation of the respective nozzle 45 which is directly connected to the discharge end 44*a*. Each of the manifolds 40 supplies streams of highly pressurized water to eight closest spray nozzles 45 on the adjacent portion of the exterior of the rotor 3. The number of manifolds 40 in a rotor 3 and the number of outlets 43 in each of the manifolds 40** can be altered without departing from the spirit of the invention.

FIG. 3 shows that the ring 64 of the spherical joint further including the spherical member 48 has a concave seat for the member 48 and a frustoconical external surface 64*a* which is received without play in a complementary conical seat 65*a* of an externally threaded annular securing member 65 which holds the spherical joint 48, 64 and hence the discharge end 44*a* of the respective conduit 44 in the corresponding holder 51. The external thread of the annular member 65 mates with the internal thread 66 of the respective holder 51. The member 65 has an outwardly extending annular portion or shroud 65*b* which surrounds the nozzle 45 with spacing and shields the nozzle 45. The holder 51 has an annular shoulder 63 and the larger-diameter end face of the ring 64 is biased against such shoulder by the annular member 65. One extreme position of the nozzle 45 and of the discharge end 44*a* of the respective conduit 44 is shown in FIG. 3 by broken lines. The spherical member 48 enables the discharge end 44*a* to swivel with reference to the respective holder 51 so as to ensure that the spray or stream issuing from the nozzle 45 is directed against the tip of the adjacent bit 50 or directly against the mine face.

FIG. 4 shows the details of one of the nozzles 45. The illustrated nozzle comprises a tubular mouthpiece 71 which is made of steel or another hard metallic material and can be coated with a layer of highly wear-resistant ceramic material. The mouthpiece 71 has an axial passage 71*a* which tapers in a direction from the axial bore of the conduit 44 toward a centrally located orifice 68 in a screw cap 69 which overlies the mouthpiece 71 and whose internal threads mate with the external threads 67 of the discharge end 44*a* of the conduit 44. The front end face of the discharge end 44*a* is formed with a counterbore 44*b* which receives the rear portion of the mouthpiece 71. The sharp annular edge 72 at the rear end of the mouthpiece 71 bears against the internal shoulder 73 at the bottom of the counterbore 44*b* under the action of the cap 69. The nozzle 45 further comprises an annular insert 70 made of sapphire or another hard and highly wear-resistant mineral substance and a collar 74 which surrounds the insert 70 and is deformed by an annular projection 76 at the front end of the mouthpiece 71. The axial passage of the insert 70 provides a path for the flow of highly pressurized fluid medium from the passage 71*a* of the mouthpiece 71 into the orifice 68 of the cap 69. The material of the mouthpiece 71 is preferably much harder than the material of the discharge end 44*a* of the conduit 44 so that the sharp edge 72 of the mouthpiece 71 bites into the shoulder 73 to thus ensure the establishment of a highly satisfactory seal and prevent the flow of pressurized fluid medium around the mouthpiece. The ceramic layer or coating can be applied to the metallic material of the mouthpiece 71 in a vaporized state. Such ceramic material preferably does not coat the edge 72. The collar 74 can be made of a suitable synthetic plastic material and cooperates with the projection 76 to prevent leakage of fluid medium between the discharge end of the passage 71*a* and the inner side of the front end wall of the screw cap 69. The insert 70 and collar 74 are partially received in a counterbore 75 in the front end face of the mouthpiece 71.

In order to connect the nozzles 45 with the respective conduits 44, the discharge ends 44*a* of the conduits 44 are passed through the respective holes 46 of the rotor 3 before the latter is affixed to the shaft 8, and the mouthpieces 71 are introduced into the respective counterbores 44*b*. The inserts 70 and the collars 74 are thereupon applied over the respective mouthpieces 71 and the screw caps 69 are applied to deform the collars 74 as well as to urge the annular edges 72 against the respective shoulders 73. This completes the attachment of nozzles 45 directly to the discharge ends 44*a* of the respective conduits 44. The spherical members 48 are preferably applied around the discharge ends 44*a* of the respective conduits 44 prior to attachment of such discharge ends to the corresponding nozzles 45. The spherical members 48 are slotted or they are assembled of several sections so as to facilitate their slipping onto or their application around the discharge ends 44*a* of the respective conduits 44. The spherical members 48 are then placed between the arcuate sections of the corresponding rings 64 in the sockets 47 of the respective holders 51 prior to the application of annular members 65 which urge the sections of the rings 64 against the external surfaces of the adjacent spherical members 48 and which also cause the larger-diameter end faces of the rings 64 to bear against the corresponding shoulders 63. Tightening of the spherical members 65 is preferably delayed until after the discharge ends 44*a* and the nozzles 45 thereon are properly oriented with reference to the adjacent bits 50. Each of the holes 46 has an enlarged portion 49 which is bounded by a preferably conical surface of the respective holder 51 and diverges in a direction away from the respective socket 47 so as to allow for changes in orientation of the discharge ends 44*a* within a required range. The diameter of the remaining portion of each hole 46 is also selected in such a way that each of these holes allows for required changes in orientation of the respective discharge ends 44*a*. The annular members 65 are thereupon tightened so that they prevent any unintentional changes in orientation of the nozzles 45.

It has been found that the aforedescribed fluid medium supplying means renders it possible to supply to the nozzles 45 water or another suitable liquid at pressures of up to and even above 2,100 bar.

An important advantage of the improved cutter is that the nozzles 45 receive highly pressurized fluid from conduits rather than from recesses, compartments or like cavities in the interior of the respective rotor 3. In heretofore known cutters, the rotor is provided with compartments and bores which deliver pressurized liquid medium directly to the nozzles. The welded seams which are used to prevent leakage of highly pressurized fluid cannot stand long periods of use and they do not permit raising of the pressure beyond a relatively low value which, at the present time, is in the range of a few hundred bars. Annular seals which are used around the intake ends of the nozzles on the rotors of conventional rotary cutters with spray nozzles also cannot stand elevated fluid pressures and their useful life at such pressures is too short.

The rotor or rotors 3 of the improved cutter 1 need not be provided with any welded seams for the purpose of resisting the pressure of the fluid medium which is being conveyed to the nozzles. As described in the aforementioned copending application of Jean Demoulin et al., that portion of the liquid supplying means which delivers fluid medium to the pipes 62 for delivery to the inlets of the respective manifolds 40 is also devoid of welded seams to thus further reduce the likelihood of premature leakage of highly pressurized fluid medium ahead of the manifolds. That portion of the fluid medium supplying means which delivers the fluid medium to the manifolds 40 can comprise relatively short pipes 62 and channels in the parts of the rotor or relatively long pipes which receive fluid medium directly from a distributor at the discharge end of a main pipe in an axial bore of the shaft 8. Sealing rings can be interposed between the distributor and the parts of the rotor and/or between the individual parts of the rotor where neighboring channels communicate with one another.

Another important advantage of the improved cutter is that the nozzles 45 are mounted directly on the discharge ends 44*a* of the respective conduits 44. This simplifies the assembly of the fluid medium supplying means and also the orientation of nozzles 45 prior to the application of annular members 65 with a force which is required to ensure that the orientation of the nozzles thereupon remains unchanged. It has been found that direct mounting of nozzles on the discharge ends of discrete pipes entails substantial savings in space which is very important in many types of rotary cutters, especially if the rotors of such cutters are to carry a large number of bits and nozzles. The conduits 44 preferably exhibit at least some flexibility so that they can be pushed back into the internal chamber of the respective rotor 3 when the attachment of the nozzles 45 to their discharge ends 44*a* is completed.

As indicated in FIG. 3 by phantom line 145, one presently preferred orientation of the nozzles 45 is such that the jet or stream of pressurized fluid medium issuing from the respective orifice 68 travels along a path extending close to the tip of the adjoining bit 50. While it is also possible to provide the sockets 47 for the nozzles 45 directly in the preferably cup-shaped skirt of the respective rotor 3, it is presently preferred to provide the sockets 47 in the corresponding holders 51. This not only allows for adequate orientation of the jets of pressurized fluid medium for the purpose of loosening and removing fragments of ore or the like from the mine face but also for adequate cooling of the adjacent holders 51 and their bits 50 as well as for extinguishing of sparks which are likely to develop when the orbiting bits penetrate into the material along the mine face.

The provision of relatively large holes 46 in the rotors 3 ensures that the orientation of the nozzles 45 can be changed without undue and pronounced bending of the discharge ends 44*a* of the respective conduits 44.

The inserts 70 contribute to longer useful life of the nozzles 45 because they surround the path for the pressurized fluid medium in regions where the nozzles are likely to undergo most pronounced wear. The provision of sharp annular edges 72 and projections 76 ensures the establishment of highly reliable seals and compensates for eventual manufacturing and/or assembly tolerances.

As disclosed in the aforementioned copending patent application, the improved cutter can have a single rotor 3. The rear end portion of its shaft 8 then receives torque from a shaft in the boom of a mole or from a transmission, such as a bevel gear transmission. If the shaft 8 carries two rotors 3 (as shown in FIG. 1), its intermediate portion can be provided with a gear which receives torque from the shaft in the interior of the boom. If the shaft 8 carries two rotors, the fluid medium supplying means for the nozzles 45 on one of the rotors 3 can be shut off while the other fluid medium supplying means receives a highly pressurized liquid and vice versa. Alternatively, shrouds can be provided to intercept the jets of pressurized fluid medium issuing from the nozzles of that rotor 3 whose bits 50 are not in the process of removing material in the surface mine or in an underground excavation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a rotary cutter, particularly for gouging out ore from mine faces, a hollow rotor; a plurality of material removing bits at the exterior of said rotor; a plurality of spray nozzles at the exterior of said rotor, said rotor including sockets for said nozzles; and means for supplying a fluid medium to said nozzles, including at least one manifold installed, and having a plurality of outlets, in the interior of said rotor, means for admitting fluid medium into said manifold, and pipes directly connecting the outlets of said manifold with discrete nozzles, said rotor having holes and said pipes extending through such holes into said sockets having discharge ends directly secured to the respective nozzles.

2. The structure of claim 1, wherein said conduits have discharge ends and the respective nozzles comprises tubular mouthpieces communicating with the discharge ends of the corresponding conduits, said discharge ends having external threads and said nozzles further comprising screw caps mating with the respective discharge ends and biasing the corresponding mouthpieces against such discharge ends, each of said screw caps having an orifice which permits for discharge of a stream of fluid medium which enters such orifice by way of the respective mouthpiece.

3. The structure of claim 2, wherein each of said mouthpieces has a passage which tapers in a direction toward the orifice of the respective cap.

4. The structure of claim 2, wherein said mouthpieces contain a hard metal.

5. The structure of claim 2, wherein said mouthpieces have coatings of a ceramic material.

6. The structure of claim 2, wherein the discharge ends of said conduits have counterbores and said mouthpieces have portions extending into the counterbores of the respective discharge ends.

7. The structure of claim 2, further comprising annular inserts interposed between said mouthpieces and the respective caps, said inserts defining paths for the flow of fluid medium from the respective mouthpieces into the corresponding orifices.

8. The structure of claim 7, wherein said inserts consist of a highly wear-resistant material.

9. The structure of claim 7, wherein said inserts consist of a mineral material.

10. The structure of claim 1, wherein said rotor comprises holders for said bits and said nozzles are installed in said holders.

11. The structure of claim 1, wherein said nozzles and said discharge ends having mating threads.

12. The structure of claim 1, wherein said pipes are metallic.

13. In a rotary cutter, particularly for gouging out ore from mine faces, a hollow rotor; a plurality of material removing bits at the exterior of said rotor; a plurality of spray nozzles at the exterior of said rotor; means for supplying a fluid medium to said nozzles, including at least one manifold installed in the interior of said rotor and having a plurality of outlets, means for admitting fluid medium into said manifold, and conduits directly connecting the outlets of said manifold with discrete nozzles, said rotor having holes and said conduits extending through such holes, and said conduits having discharge ends connected to the respective nozzles; and spherical joints installed in said rotor and each receiving the discharge end of a conduit so as to allow for changes in orientation of the nozzles and of the discharge ends of the respective conduits relative to said rotor.

14. The structure of claim 13, wherein said rotor comprises sockets for said nozzles and said conduits have discharge ends extending into said sockets and secured to the respective nozzles.

15. The structure of claim 13, wherein each of said joints comprises a spherical member surrounding the discharge end of the respective conduit and a ring installed in said rotor and having a concave seat for said spherical member.

16. The structure of claim 15, wherein each of said spherical members consists of several separable sections.

17. The structure of claim 15, wherein each of said rings consists of several separable arcuate sections.

18. The structure of claim 15, wherein each of said rings has a conical external surface and further comprising means for securing said rings to said rotor.

19. The structure of claim 18, wherein each of said securing means comprises an externally threaded annular member mating with said rotor and having a conical seat for the respective ring, said rotor having shoulders and said annular members being arranged to bias the respective rings against such shoulders.

20. The structure of claim 18, wherein each of said securing means has an annular portion spacedly surrounding the respective nozzle.

21. In a rotary cutter, particularly for gouging out ore from mine faces, a hollow rotor; a plurality of material removing bits at the exterior of said rotor; a plurality of spray nozzles at the exterior of said rotor; means for supplying a fluid medium to said nozzles, including at least one manifold installed in the interior of said rotor and having a plurality of outlets, means for admitting fluid medium into said manifold, and conduits directly connecting the outlets of said manifold with discrete nozzles, said rotor having holes and said conduits extending through such holes, and said conduits having discharge ends connected to the respective nozzles; and joints installed in said rotor and each receiving the discharge end of a conduit so as to allow for change in orientation of the nozzles and of the discharge ends of the respective conduits relative to said rotor, said holes being dimensioned to allow for changes in orientation of the respective conduits and nozzles with reference to said rotor.

22. The structure of claim 21, wherein each of said holes has an enlarged portion which diverges in a direction from the respective joint toward the interior of said rotor.

23. In a rotary cutter, particularly for gouging out ore from mine faces, a hollow rotor; a plurality of material removing bits at the exterior of said rotor; a plurality of spray nozzles at the exterior of said rotor, said rotor including sockets for said nozzles; and means for supplying a fluid medium to said nozzles, including at least one manifold installed, and having a plurality of outlets, in the interior of said rotor, means for admitting fluid medium into said manifold, and pipes directly connecting the outlets of said manifold with discrete nozzles, said rotor having holes and said pipes extending through such holes, and said pipes having discharge ends directly secured to the respective nozzles, said nozzles comprising tubular mouthpieces communicating with the discharge ends of the corresponding pipes, said discharge ends having external threads and said nozzles further comprising screw caps mating with the threads of the respective discharge ends and biasing the corresponding mouthpieces against such discharge ends, each of said screw caps having an orifice which permits for discharge of a stream of fluid medium which enters such orifice by way of the respective mouthpiece, the discharge ends of said pipes having counterbores and said mouthpieces having portions extending into the counterbores of the respective discharge ends, said discharge ends further having internal shoulders at the bottoms of their counterbores and said mouthpieces having sharp annular edges bearing against the shoulders of the respective discharge ends under the action of the respective caps.

24. In a rotary cutter, particularly for gouging out ore from mine faces, a hollow rotor; plurality of material removing bits at the exterior of said rotor; a plurality of spray nozzles at the exterior of said rotor, said rotor including sockets for said nozzles; and means for supplying a fluid medium to said nozzles, including at least one manifold installed, and having a plurality of outlets, in the interior of said rotor, means for admitting fluid medium into said manifold, and pipes directly connecting the outlets of said manifold with discrete nozzles, said rotor having holes and said pipes extending through such holes and said pipes having discharge ends directly secured to the respective nozzles, said nozzles comprising tubular mouthpieces communicating with the discharge ends of the corresponding pipes, said discharge ends having external threads and said nozzles further comprising screw caps mating with the threads of the respective discharge ends and biasing the corresponding mouthpieces against such discharge ends, each of said screw caps having an orifice which permits for discharge of a stream of fluid medium which enters such orifice by way of the respective mouthpiece, said mouthpieces having sharp rear edges which are biased against the adjacent portions of the respective discharge ends by the corresponding caps.

25. In a rotary cutter, particularly for gouging out ore from mine faces, a hollow rotor; a plurality of material removing bits at the exterior of said rotor; a plurality of spray nozzles at the exterior of said rotor, said rotor including sockets for said nozzles; and means for supplying a fluid medium to said nozzles, including at least one manifold installed, and having a plurality of outlets, in the interior of said rotor, means for admitting fluid medium into said manifold, and pipes directly connecting the outlets of said manifold with discrete nozzles, said rotor having holes and said pipes extending through such holes, and said pipes having discharge ends directly secured to the respective nozzles, said nozzles comprising tubular mouthpieces communicating with the discharge ends of the corresponding pipes, said discharge ends having external threads and said nozzles further comprising screw caps mating with the threads of the respective discharge ends and biasing the corresponding mouthpieces against such discharge ends, each of said screw caps having an orifice which permits for discharge of a stream of fluid medium which enters such orifice by way of the respective mouthpiece, said nozzles further comprising annular inserts interposed between said mouthpieces and the respective caps, said inserts defining paths for the flow of fluid medium from the respective mouthpieces into the corresponding orifices, said nozzles also comprising collars surrounding said inserts, said mouthpieces consisting of a hard metal and having projections extending into the respective collars.

26. In a rotary cutter, particularly for gouging out ore from mine faces, a hollow rotor; a plurality of material removing bits at the exterior of said rotor; a plurality of spray nozzles at the exterior of said rotor, said rotor including sockets for said nozzles; and means for supplying a fluid medium to said nozzles, including at least one manifold installed, and having a plurality of outlets, in the interior of said rotor, means for admitting fluid medium into said manifold, and pipes directly connecting the outlets of said manifold with discrete nozzles, said rotor having holes and said pipes extending through such holes, and said pipes having discharge ends directly secured to the respective nozzles; and joints installed in said rotor and each receiving the discharge end of a pipe so as to allow for changes in orientation of the nozzles and of the discharge ends of the respective pipes relative to said rotor.

* * * * *